US008261563B2

(12) United States Patent
Khrustalev et al.

(10) Patent No.: US 8,261,563 B2
(45) Date of Patent: Sep. 11, 2012

(54) EXTERNAL REFRIGERATOR CONDENSING UNIT

(76) Inventors: Lev Khrustalev, Moscow (RU); Alex Mindich, Glenview, IL (US)

( * ) Notice: Subject to any disclaimer, the term of this patent is extended or adjusted under 35 U.S.C. 154(b) by 1192 days.

(21) Appl. No.: 12/039,801

(22) Filed: Feb. 29, 2008

(65) Prior Publication Data

US 2009/0217700 A1 Sep. 3, 2009

(51) Int. Cl.

| | |
|---|---|
| ***F25D 15/00*** | (2006.01) |
| ***F25D 5/00*** | (2006.01) |
| ***F25D 19/00*** | (2006.01) |
| ***F25B 27/00*** | (2006.01) |
| ***F28D 15/00*** | (2006.01) |

(52) U.S. Cl. ..... 62/119; 62/305; 62/452; 62/506; 62/238.4; 165/104.24; 165/130; 165/104.22

(58) Field of Classification Search ..... 62/98, 99, 62/305, 439, 498, 506, 513, 452, 119, 238.4, 62/335, 78; 165/104.22, 104.24, 130
See application file for complete search history.

(56) References Cited

U.S. PATENT DOCUMENTS

| | | | | |
|---|---|---|---|---|
| 2,077,021 | A * | 4/1937 | Sites | 62/150 |
| 2,181,354 | A * | 11/1939 | Winters | 62/115 |
| 4,144,718 | A * | 3/1979 | Williams | 62/180 |
| 4,932,221 | A * | 6/1990 | Shimizu et al. | 62/180 |
| 5,689,966 | A * | 11/1997 | Zess et al. | 62/238.6 |
| 5,860,798 | A * | 1/1999 | Tschopp | 417/502 |
| 6,808,011 | B2 * | 10/2004 | Lindemuth et al. | 165/45 |
| 2001/0015076 | A1 * | 8/2001 | Schulak et al. | 62/440 |
| 2006/0124282 | A1 * | 6/2006 | Bellott et al. | 165/132 |

* cited by examiner

*Primary Examiner* — Cheryl J Tyler
*Assistant Examiner* — Cassey D Bauer
(74) *Attorney, Agent, or Firm* — Schiff Hardin LLP

(57) ABSTRACT

An apparatus provides a high efficiency for refrigerator operation. The inclusion of a separate external evaporator and condenser that draws heat away from the common refrigerator condenser allows an increase in the intensity of the cooling process of the cooling agent, thereby diminishing electrical consumption, and decreasing the size and noise of the condenser. This is achieved by structuring the refrigerator condenser with the one tube for the cooling agent of the common refrigerator and another volume for evaporating the cooling substance of the external evaporator and condenser. Moreover, external system of natural cooling has a condenser that is located in the open air and connected to the evaporator with the help of vapor lines and condensed vapor lines.

17 Claims, 6 Drawing Sheets

EXTERNAL REFRIGERATOR CONDENSING UNIT

BACKGROUND

The present invention relates to the field of refrigerating, and particularly to condensers used in common refrigerators.

Known condensers common refrigerators contain a serpentine pipe with connected wire ribs that have projections in various planes (S. I. Kolokolov Condenser of the Home Refrigerator, Author Certificate (A. C.) 1 335 787. Bulletin No. 33, 1987), herein incorporated by reference. In these designs, a cooling agent of the refrigerator becomes cool due to free air convection in the room at the condenser surface.

One deficiency of these known condensers is their slow process of cooling because of the small air velocity at the condenser surface and its relatively high (room) temperature; this leads to a long working time of the compressor, and, as a result, to the higher consumption of electrical energy.

It is also known for common refrigerator condensers to contain a heat exchanger comprising: (a) a grounded electrode connected to a refrigerator housing wall, (b) a high-voltage electrode located between the heat exchanger and the refrigerator housing wall, and (c) a special cover (B. S. Babkin, I. A. Rogov, M. R. Bovkun and V. D. Mikhailov Condenser of the Air Cooling, A. C. 1 548 625, Bulletin No. 9, 1990), herein incorporated by reference. In this design, the cooling agent becomes cool due to free room air convection, which is intensified due to ionizing of the air in the vicinity of the condenser surface in order to create a so called "electrical wind."

Deficiencies of this known condenser include: (a) a small cooling intensity because of a small air velocity at the condenser surface even with consideration of the "electrical wind" and its relatively high (room) temperature; this leads to a long working time of the compressor, and, as a result, to the higher consumption of electrical energy; (b) an energy consumption for creation of the "electrical wind"; and (c) increased safety requirements.

In one relevant known system, a refrigerating machine condenser contains an increased heat transferring surface that is made of: (a) serpentine pipe with ribs, in which the prime refrigerator cooling agent is moving, (b) an electrical ventilator unit, (c) volume around the serpentine pipe made as a porous capillary structure for evaporating the secondary coolant, which is water; this volume covers pipe serpentine surface and has special wicks immersed in the water tank (B. T. Marinuk Condenser of Refrigerating Machine. Russian Patent RU 2117885 C1, Bulletin No. 23, 1998), herein incorporated by reference. In this design, the cooling agent is cooled down due to water evaporation within the porous capillary structure, and the process is intensified with an electrical ventilator blowing room air on the porous capillary structure surface.

Deficiencies of this known condenser include: (a) an increased consumption of electrical energy because of the power consumed by the electrical ventilator; (b) a high noise level from the working fan; (c) the size of the whole set up is too big for placing in most homes; and (d) an insufficient cooling intensity because of the high temperature of blowing room air.

SUMMARY

Accordingly, various embodiments of the present invention are advantageous in that they may provide: (a) an increase in the cooling down intensity of the cooling agent, (b) a decrease in electrical energy consumption, (c) a decrease in the overall refrigerator dimensions, and (d) an essentially complete reduction in noise.

In order to fulfill these technical achievements, a generic embodiment of the invention is directed to a refrigerator condenser assembly, comprising: a refrigerator pipe containing a refrigerator cooling agent; and an additional cooling assembly, comprising: a structure enclosing a volume adjacent to the refrigerator pipe, wherein the refrigerator pipe and the structure enclosing the volume may be manufactured as a unified construction unit, e.g., a pipe-in-pipe structure, and the adjacent volume comprises an additional cooling substance that fills the structure enclosing the volume, preferable a light boiling liquid, e.g., Freon-22.

That structure enclosing a volume adjacent to the refrigerator pipe serves as an evaporator for an additional cooling substance, and is advantageous in that it draws heat away from the refrigerator pipe because the light boiling liquid draws away at least the latent heat of vaporization for changing its state from liquid to vapor (plus any heat required for a further temperature change), thereby taking away that heat from the refrigerator cooling agent and thus cooling it down.

Due to the fact that latent heat of vaporization requires much more heat energy than the specific heat for the same material, the heat transfer between the cooling agent of refrigerator and cooling substance in the enclosing volume is much more intensive than in the process of convection heat transfer. For the additional cooling assembly, a remote condensing unit located remotely from the refrigerator pipe condenses the additional cooling substance, and the vapor and condensed vapor lines connect the remote condensing unit and the structure enclosing the adjacent volume that convey evaporated additional cooling substance and condensed additional cooling substance respectively.

A first embodiment provides an apparatus that comprises a condenser of the common refrigerator that is implemented as a "pipe-in-pipe" design, with an inner pipe for the prime cooling agent of the refrigerator, and an outer pipe for the secondary cooling agent. The secondary cooling substance is a light boiling liquid, e.g., Freon-22, and the outer pipe is an evaporator of the system of natural cooling (G. M. Dolgikh & V. B. Gamarnik, System of Temperature Stabilization of Bed of Construction Built on Permafrost, Russian Patent Author Certificate 1426151, 1988), herein incorporated by reference, where the condenser is located in the open air and is connected to the evaporator with the help of vapor pipes and condensed vapor pipes. A pipe-in-pipe tube configuration is commercially available from, e.g., Edwards Coils Corporation, 101 Alexander Ave., Prompton Plains, N.J. 07444, (www.edwardscoils.com).

Thus, various embodiments of the invention incorporate the features that: (a) the volume surrounding the serpentine pipe of a refrigerator condenser is used as an evaporator of the system of natural cooling, which condenser is located outside of the home or business in the open air and connected to the evaporator with the help of vapor pipes and condensed vapor pipes; (b) the light boiling liquid, e.g., Freon-22, or a material with suitable similar characteristics, is used as a cooling substance; and (c) the serpentine pipe and surrounding volume are carried out as a pipe-in-pipe design with one pipe for the prime cooling agent of the refrigerator (or "refrigerator cooling agent") and another pipe for a secondary cooling agent (or "cooling substance of the system of natural cooling").

By such a design, the goals can be achieved: an intensity increase of the cooling down of the cooling agent, a decrease of electrical energy consumption, a decrease in the overall dimensions, and an essentially complete noise elimination, namely the system of natural cooling, which executes a cooling of the serpentine pipe of the common refrigerator, and that is working simply by virtue of the temperature difference between atmosphere air and serpentine surface. A suggested system of natural cooling is self-regulated. It works only when the outside temperature is lower than the room temperature. As soon as temperature of the remote condenser becomes higher than the temperature of the evaporator inside the room, there is no movement of the cooling substance from the evaporator to the condenser and thus the system locks itself, i.e., the flow stops and the system is self-regulating.

In contrast, as soon as the remote condenser becomes about 2° C. cooler than the evaporator inside the room, the circulation process of the cooling substance starts again and continues until the temperature of the condenser is lower than the temperature of the evaporator. This system of natural cooling can be analogized with a semiconductor diode that permits flow in only one direction. It transfers heat only from the refrigerator to the remote condenser to the atmosphere air, and not in an opposite direction. Various embodiments of the invention consider the situation when refrigerator compressor is not working, but there is still a heat transfer from the room outside due to differences in the room and atmosphere temperature. In order to prevent undesirable loss of heat energy, there may be a shut-off valve on the cooling substance liquid pipe. A shut-off valve can be provided to curtail circulation of the cooling substance under these circumstances. Such a shut-off valve can be manually or automatically operated, based in input from temperature sensors.

This design does not require any additional energy beyond the conventional design, is very quiet, and its overall dimensions inside the room are determined by the size of the additional volume around the serpentine pipe. The latter are assumed from the equality of the cross section area of the space between tube and cross section area of the inner tube. Additionally, the heat from the home refrigerator is transferred directly into the atmosphere, where the annual mean temperature usually is much lower than room temperature; this leads to an increased intensity of the cooling process, and accordingly, to a decrease of the working time of the common refrigerator compressor, and hence to the economy of electricity utilization.

In cases where a water supply is used for cooling down the refrigerator cooling agent and the water serpentine line is located inside of refrigerator condenser serpentine line, embodiments of the invention may include evaporator serpentine pipe of the system of natural cooling being located parallel to the water serpentine line. In this application the system of natural cooling reduces or eliminates a necessary water supply system, depending on differences between the inside and outside temperature. A shut-off valve may be provided to curtail circulation of the water supply under these circumstances. Such a shut-off valve can be manually or automatically operated, based in input from temperature sensors.

Other embodiments include various mutual location of the evaporator serpentine pipe of the system of natural cooling and the water supply serpentine pipe. Depending on the results of engineering calculations based on heat transfer demands and climate conditions, the evaporator serpentine pipe of the system of natural cooling can be located inside of the water supply serpentine pipe, or include the latter within itself, or both the water supply serpentine pipe and the evaporator serpentine pipe of the system of natural cooling can be located parallel and within the serpentine pipe of the refrigerator condenser.

A final embodiment shows that the refrigerator cooling agent line is divided on two separated parallel arrangements: one includes the refrigerator cooling agent serpentine pipe, inside of which (pipe-in-pipe) the cooling substance evaporator serpentine line is located, the second arrangement includes the refrigerator cooling agent serpentine pipe, inside of which (pipe-in-pipe) the water supply serpentine line is installed. Finally, both arrangements are joined into one line with only the refrigerator cooling agent. The two "competing" system may work beneficially for the final result because when one system (e.g., the water cooling supply) is shut-off, it does not interfere with the working natural cooling system that is in the same serpentine pipe of the refrigerator cooling agent.

DESCRIPTION OF THE DRAWINGS

The invention is described below with reference to various preferred embodiments illustrated in the drawings and explained in greater detail below.

DETAILED DESCRIPTION OF THE PREFERRED EMBODIMENTS

Figure 1:
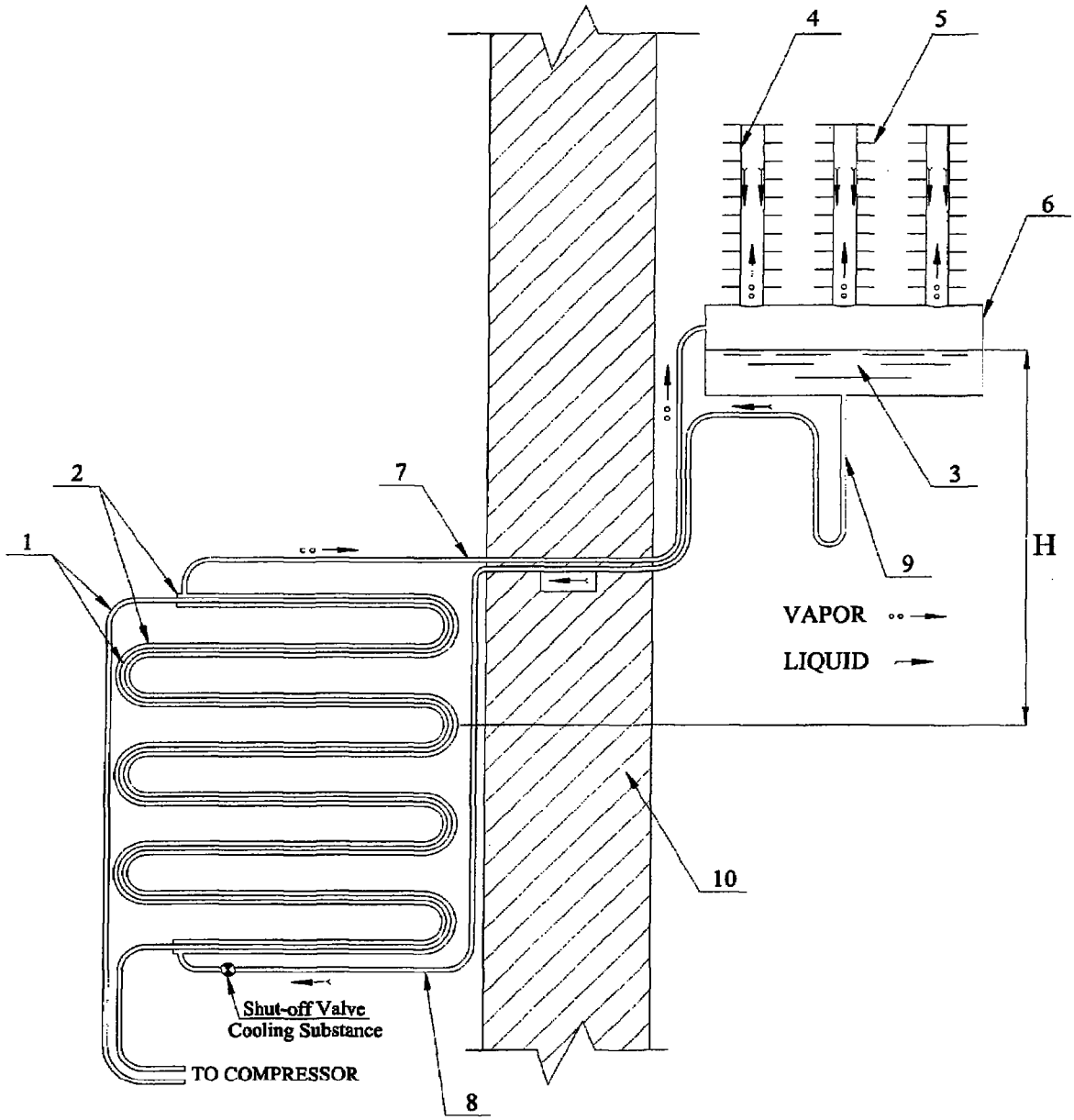
FIG. 1 is a pictorial schematic diagram according to a first embodiment of the invention in which the external condenser cooling substance surrounds the refrigerator serpentine pipe.

FIG. 1 illustrates an embodiment of the inventive apparatus, and shows a condenser of the common refrigerator that is made as a serpentine pipe 1 for the cooling agent and has a surrounding volume for a cooling substance. It is structurally arranged as a tube-in-tube with the refrigerator pipe 1 being an inner tube in the first embodiment for the cooling agent of the common refrigerator and an evaporator pipe 2 being an outer tube in the first embodiment for the cooling substance which is preferably a light boiling liquid 3 (such as Freon-22 or an equivalent). The volume between the pipes 1 and 2 functions as an evaporator of the system of natural cooling, which comprises a set of pipes 4 with ring ribs 5 and a leveling vessel 6, a vapor pipe 7, a condensed vapor pipe 8 with a hydraulic lock 9. The vapor pipe 7 and condensed vapor pipe 8 extend through a building wall 10. The cooling system 2-9 is filled with the light boiling liquid 3 up to the center of the leveling vessel 6.

The apparatus functions as described in the following. When the compressor of the common refrigerator is working, the refrigerator pipe 1 warms up to the temperature of condensation of the cooling agent and warms up the cooling substance 3, which is located between pipes 1 and 2. The cooling substance 3 evaporates when it is warmed up, and its vapor forces part of the cooling substance 3 out of tubes 2 and 7 into the leveling vessel 6. It is further possible to include a shut-off valve in the line associated with the cooling substance. This permits the flow of the cooling substance to be turned off if use of the external cooling system is not desired (e.g., in the event that the external temperature is cooler than the ambient temperature near the refrigerator serpentine pipe 1).

The hydraulic lock 9 does not allow vapor of the cooling substance 3 to move along the condensed vapor pipe 8 and determines movement of the vapor of the cooling substance 3 as well as movement of the vapor-liquid mixture in one direction only, namely from the lower portion of the leveling vessel 6 along the condensed vapor pipe 8, evaporator pipe 2 and a vapor pipe 7 into the upper part of the leveling vessel 6 and further into the set of pipes 4, where it transfers heat to the atmosphere. The vapor then loses heat energy which lowers its temperature and condenses into a liquid on the inner surface of the pipes and flows down into the leveling vessel 6, from which it circulates again into the system. This cycle interrupts when the atmosphere air temperature becomes higher than the cooling agent temperature in pipe 1 (when the compressor of the common refrigerator is shut off). The cooling substance 3 warms up and transfers into the vapor completely while moving along the pipe 2. Therefore, there are two flows in the pipe-in-pipe system: the flow of the condensing cooling agent of the common refrigerator, which is moving along the pipe 1 due to pressure from the common refrigerator compressor, and the flow of the evaporating cooling substance 3, which is moving along the pipe 2 due to gravity. Interaction of the two flows as described results in intensive heat transfer between the cooling agent of the common refrigerator and cooling substance of the system of natural cooling.

The gravity pressure acting on the cooling substance 3 can be determined by Equation (1):

$$P=g\cdot(\rho_{liquid}-\rho_{vapor})\cdot H \quad (1)$$

where

P=pressure due to gravity, Pa;

g=acceleration due to gravity, 9.81 m/s$^2$;

$\rho_{liquid}$ & $\rho_{vapor}$=density of the cooling substance, in liquid and vapor states respectively, kg/m$^3$;

H=vertical distance between the upper level of the liquid phase of the cooling substance 3 in the level vessel 6 and the middle height of the pipe 2, m.

Comparative calculations have been made for the heat removing capabilities of the known condensers for common refrigerators and the inventive condensers described herein. The calculated results prove that there is a high effectiveness of the suggested apparatus, and this effectiveness grows as one moves from warmer climates to colder climates. Thus, for the Moscow, Russia region, the yearly average intensity of the heat transfer for the suggested condenser surpasses the heat removal of the "standard" refrigerator by a factor of 2.4 times; this therefore results in the common refrigerator compressor working time and electrical consumption being reduced by the same factor of 2.4 times.

In warmer climate areas, where the outer temperature is not so low or where the summer day time atmosphere temperature can be higher than the room temperature surrounding the common refrigerator, the natural cooling system may becomes less efficient as described above, since it cannot dissipate heat into the atmosphere efficiently.

Figure 2:
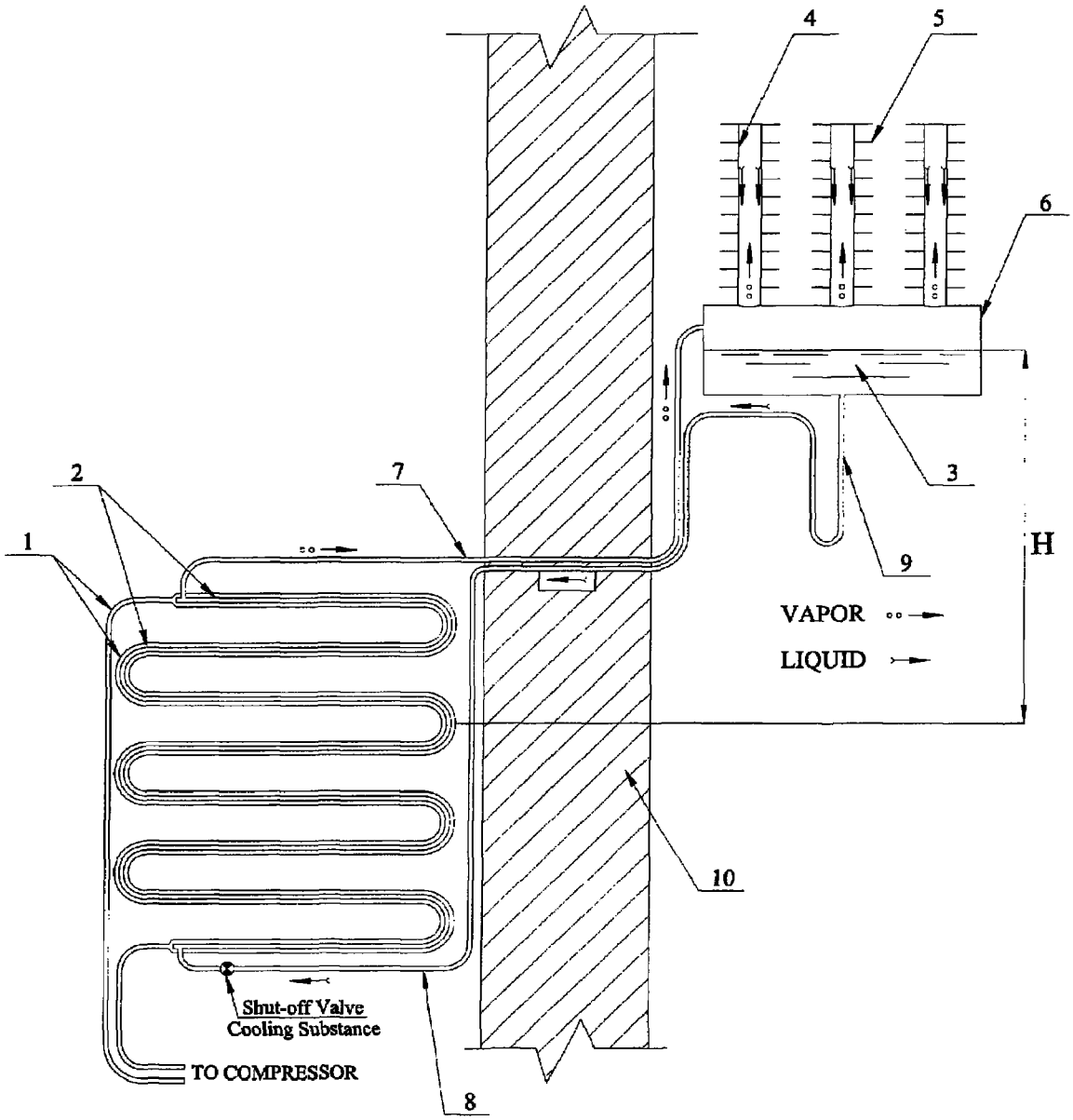
FIG. 2 is a pictorial schematic diagram according to a second embodiment of the invention in which the external condenser cooling substance is located within the refrigerator serpentine pipe.

In order to avoid the situation where the outer volume is not moving vapor of the cooling substance around serpentine pipe of the common refrigerator condenser and may become an additional heat transfer resistance for the original working common refrigerator, it is recommended that the evaporator of the natural cooling system be installed inside of the condenser serpentine pipe of the common refrigerator, as it is shown in FIG. 2. The working parameters of the second embodiment system are very similar to the first embodiment, however, during the time when the atmosphere temperature is temporarily higher than the ambient room temperature of the common refrigerator, the system then works according to the known systems with the original design efficiency using free air convection in the room at the condenser surface. The following provides the comparative calculations used for the analysis.

Figure 3:
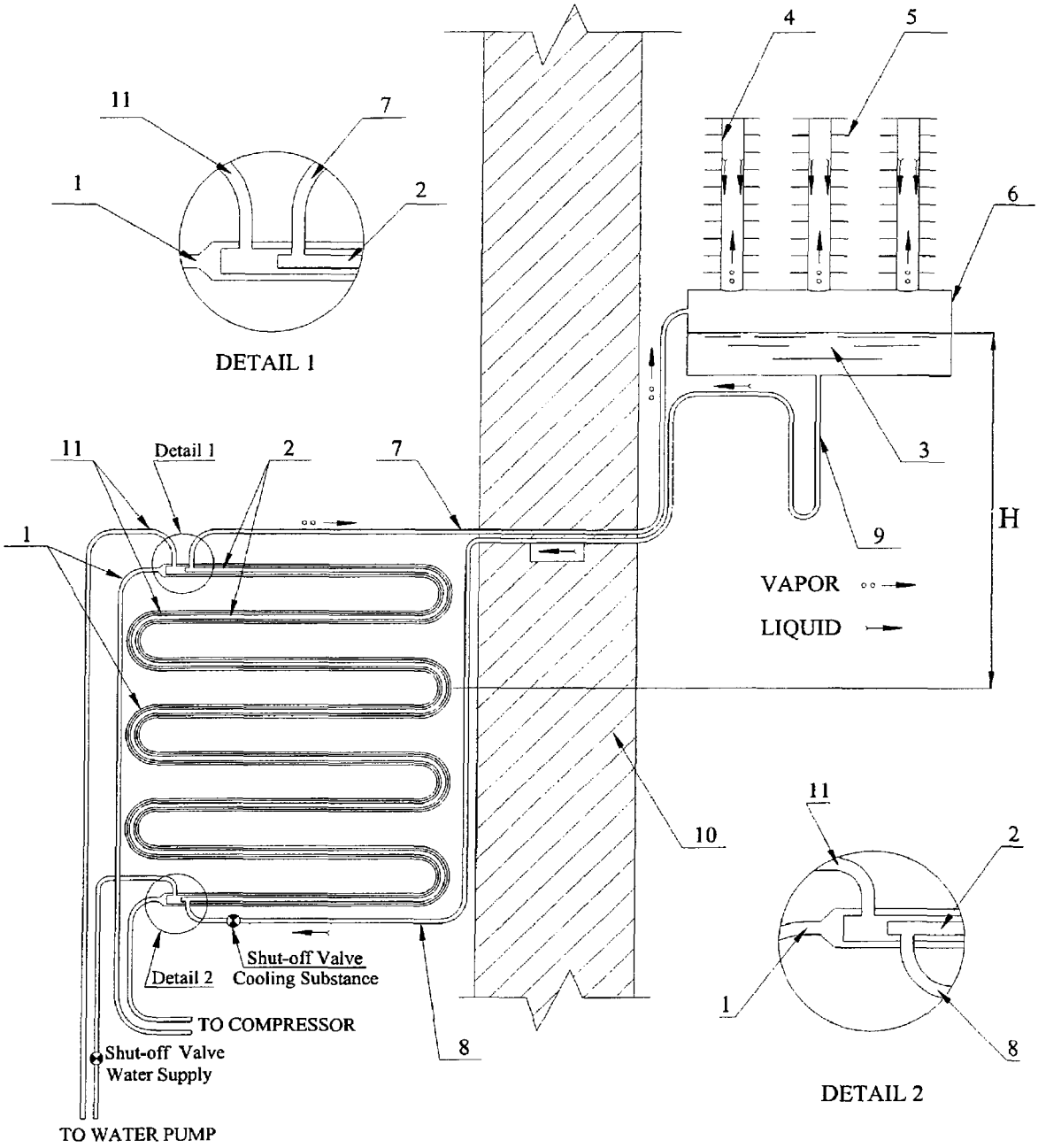
FIG. 3 is a pictorial schematic diagram according to a third embodiment of the invention for the refrigerator using a water supply for cooling the refrigerator condenser in which the evaporator of the system of natural cooling is located within a water supply serpentine pipe.

FIG. 3 illustrates an embodiment for the refrigerator using a water supply with respective water supply lines 11 for cooling the refrigerator condenser lines 1 in which the evaporator of the system of natural cooling is located within a water supply serpentine pipe 11. It should be noted that a shut-off valve for the water supply can also be provided.

Figure 4:
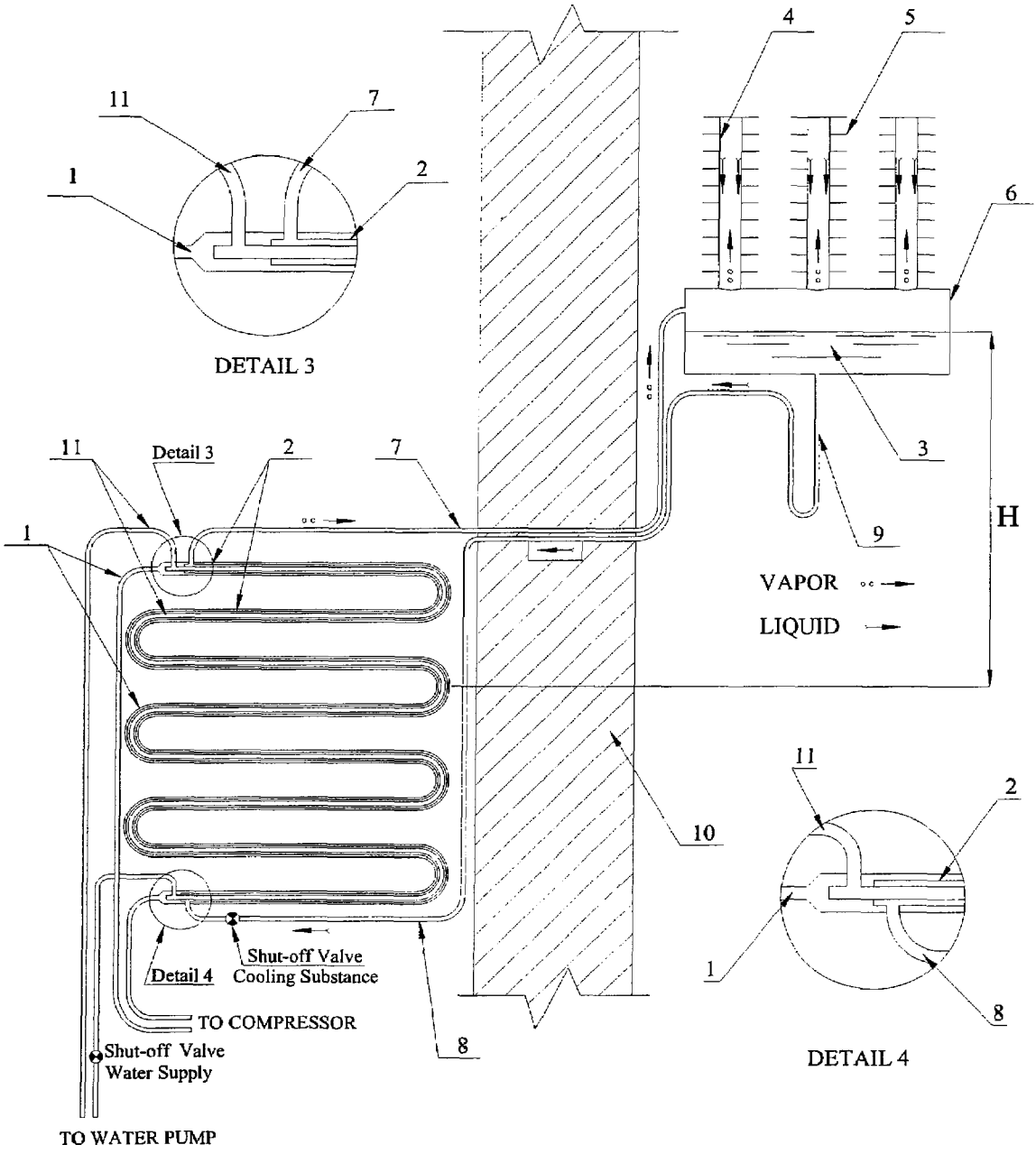
FIG. 4 is a pictorial schematic diagram according to a fourth embodiment of the invention for the refrigerator using a water supply for cooling the refrigerator condenser in which the evaporator of the system of natural cooling is located outside of the water supply serpentine pipe.

FIG. 4 illustrates an embodiment for the refrigerator using a water supply with respective water supply lines 11 for cooling the refrigerator condenser lines 1 in which the evaporator of the system of natural cooling is located outside of the water supply serpentine pipe 11.

Figure 5:
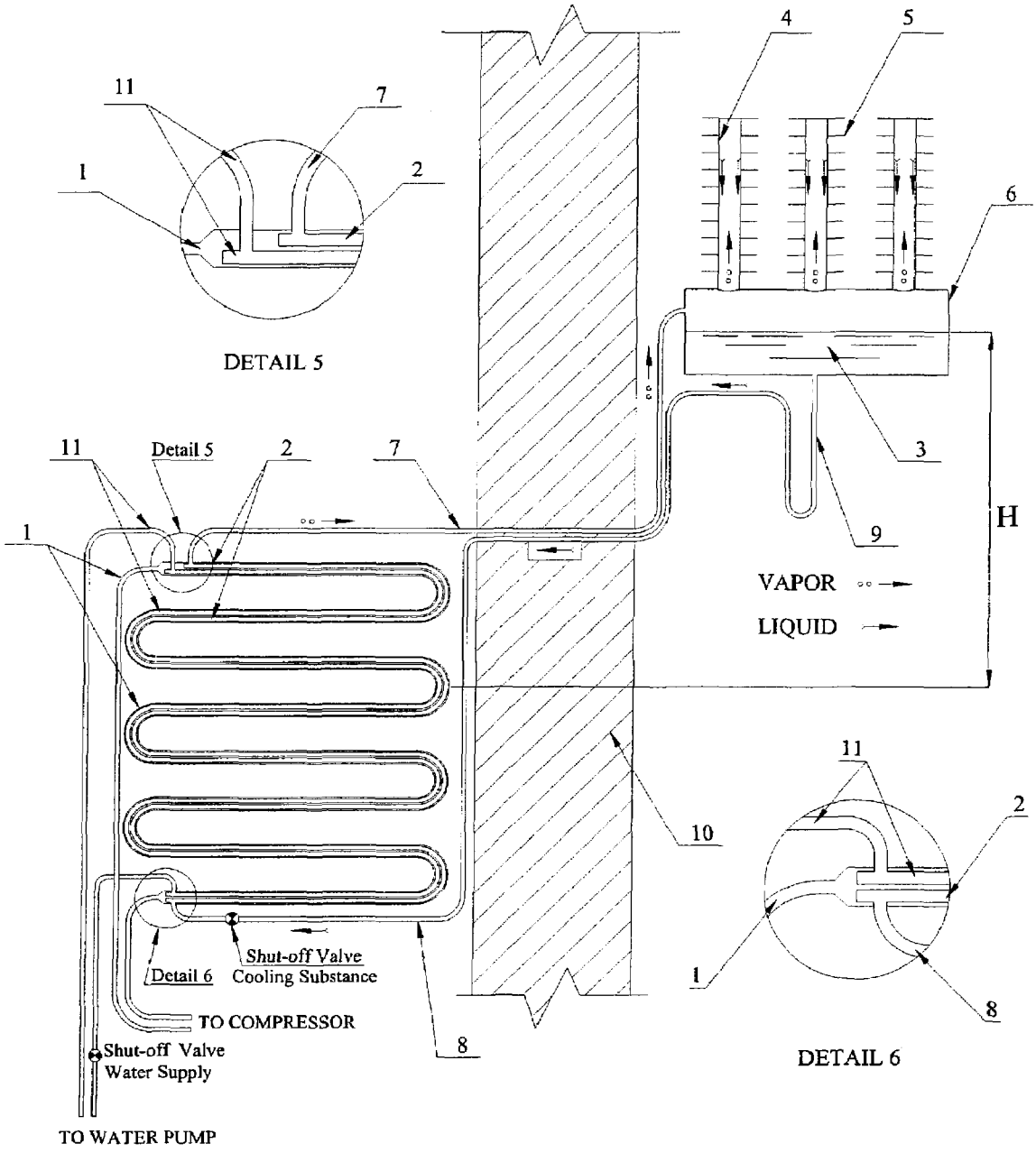
FIG. 5 is a pictorial schematic diagram according to a fifth embodiment of the invention for the refrigerator using a water supply for cooling the refrigerator condenser in which the serpentine pipe of the evaporator of the system of natural cooling and the water supply serpentine pipe are parallel and both located within the refrigerator serpentine pipe.

FIG. 5 illustrates an embodiment for the refrigerator using a water supply with respective water supply lines 11 for cooling refrigerator condenser lines 1 in which the serpentine pipe 2 of the evaporator of the system of natural cooling and the water supply serpentine pipe are parallel and both located within the refrigerator serpentine pipe 1.

Figure 6:
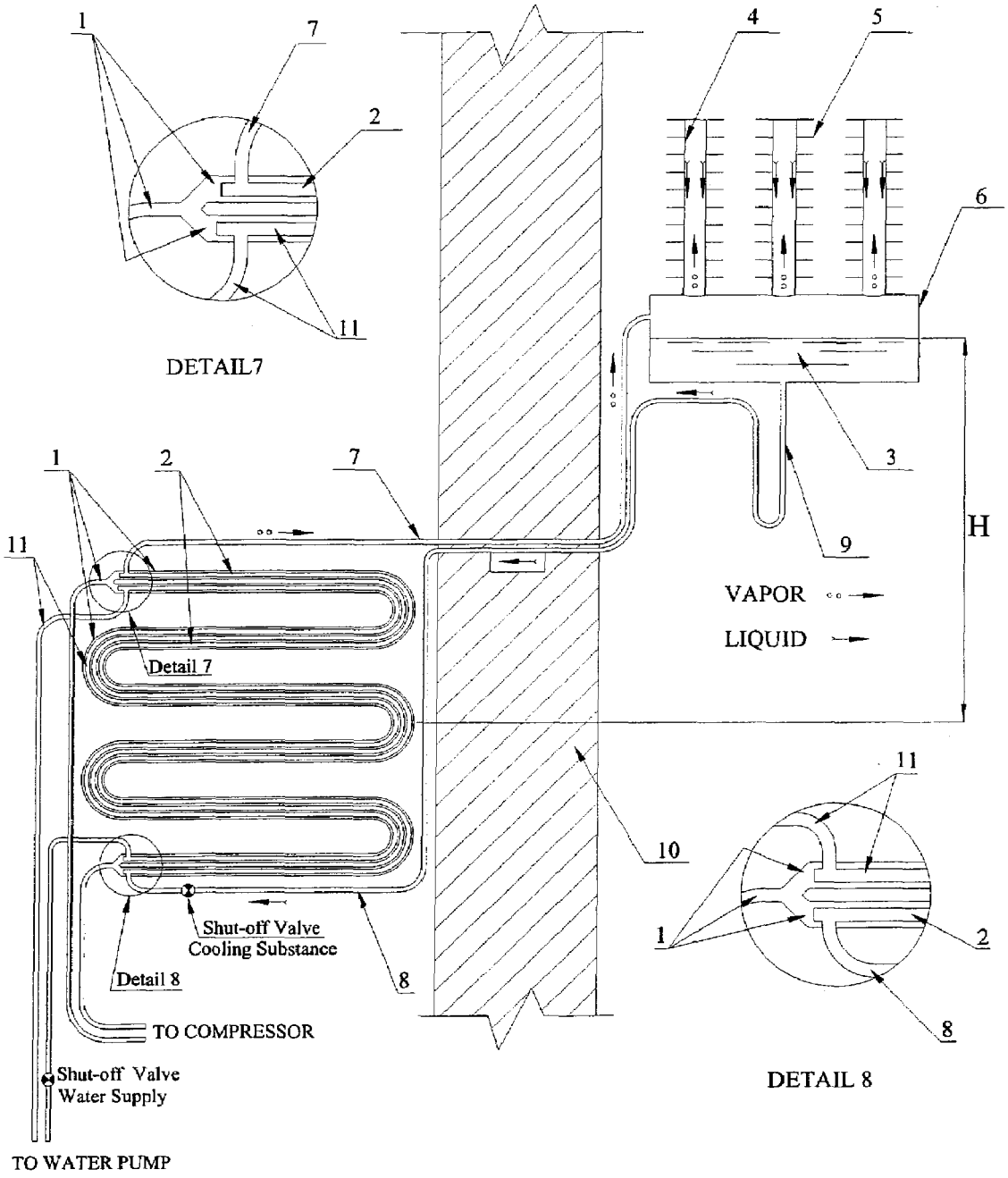
FIG. 6 is a pictorial schematic diagram according to a sixth embodiment of the invention for the refrigerator using a water supply for cooling the refrigerator condenser in which the serpentine pipe of the evaporator of the system of natural cooling and the water supply serpentine pipe are parallel and separated and each located within the divided portion on the two refrigerator serpentine pipes.

FIG. 6 illustrates an embodiment of the invention for the refrigerator using a water supply 11 for cooling the refrigerator condenser 1 in which the serpentine pipe 2 of the evaporator of the system of natural cooling and the water supply serpentine pipe 11 are parallel and separated and each located within the divided portion on the two refrigerator serpentine pipes 1.

Calculation of the Intensity of the Heat Transferring into a Room (in a Common Refrigerator without the Present System of Natural Cooling)

The intensity of the heat transferring from the common refrigerator condenser into the room can be determined by equation (2):

$$q_1 \cong F_k\cdot\beta\cdot\alpha_1\cdot(t_k-t_{room}) \quad (2)$$

where $q_1$=intensity of the heat transferring from the common refrigerator condenser into the room, W;

$F_k$=area of the outer surface of the condenser tube, m$^2$;

$\beta$=coefficient due to the presence of the ribs (usually $\beta$=5);

$\alpha_1$=coefficient of the heat exchange between the outer condenser surface and room air (for common refrigerators, within the limits of 6-8 W/(m$^2$° C.);

$t_k$=temperature of condensation of the cooling agent, which depends on the pressure developed by the compressor (for common refrigerators, usually $t_k$=35° C.);

$t_{room}$=room air temperature, ° C.

For the calculations, the following assumptions are made for initial data: the diameter of the condenser tube 0.006 m, its length is 12 m ($F_k$=0.226 $m^2$), β=5, $\alpha_1$=8 W/($m^{2\circ}$ C.), $t_k$=35° C., and $t_{room}$=20° C.

Putting these data in Eq. (2) results in:

$$q_1=0.226\cdot5\cdot8\cdot(35-20)=135.6\text{ W.}$$

Calculation of the Intensity of the Heat Transferring Directly into the Outside Atmosphere (in a Common Refrigerator with the Present System of Natural Cooling)

Intensity of the heat transferring from the common refrigerator condenser into the atmosphere can be determined by equation (3):

$$q_2\approx F_k^*\cdot\alpha_2\cdot(t_k-t_{air}-\Delta t) \quad (3)$$

where $q_2$=intensity of the heat transferring into the atmosphere, W;

$F_k$*=area of the outer surface of the condenser of the system of natural cooling, including the ribs, $m^2$;

$\alpha_2$=coefficient of the heat exchange between the outer condenser surface and atmosphere air, depends on wind speed and condenser pipe diameter, taken from special tables (Basic of Geocreology, Chapter 5. Engineering Geocreology (under editorial of L. N. Khrustalev and E. D. Ershov) Moscow State University Publishing House, Moscow, 1999, page 526), W/($m^{2\circ}$ C.);

$t_{air}$=average yearly air temperature (for the Moscow, Russia region, this value equals 3.8° C.);

Δt=temperature difference between the system of natural cooling condenser surface and atmosphere air, this value equals 2° C.

For the calculations, the following assumptions are made for initial data: $F_k$*=1.5·$F_k$=1.5·0.226=0.339 $m^2$, $\alpha_2$ is assumed for the Moscow region to be 33.3 W/( $m^{2\circ}$ C.), $t_k$=35° C., $t_{air}$=3.8° C., Δt=2° C.

Putting these data in Eq. (3) results in:

$$q_2=0.339\cdot33.3\cdot(35-3.8-2)=329.6\text{ W.}$$

Thus, for the Moscow region, the yearly average intensity of the heat transfer for the suggested condenser surpasses the heat removal of the "standard" common refrigerator by a factor of 2.4 times; and correspondingly reduces the common refrigerator compressor working time and electrical consumption by the same 2.4 factor.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art.

For example, the term "common" refrigerator, as used herein, include various type of refrigerators, and does not specifically limit the invention to use in home refrigerators, or to refrigerators in commercial establishments.

The particular implementations shown and described herein are illustrative examples of the invention and are not intended to otherwise limit the scope of the invention in any way. For the sake of brevity, conventional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". The word mechanism is intended to be used generally and is not limited solely to mechanical embodiments. Numerous modifications and adaptations will be readily apparent to those skilled in this art without departing from the spirit and scope of the invention.

What is claimed is:

1. A refrigerator condenser assembly, comprising:

a refrigerator condenser pipe containing a refrigerator cooling agent; and an additional cooling system for cooling the refrigerator condenser pipe, comprising:

an evaporator structure enclosing a volume adjacent to the refrigerator condenser pipe, wherein the volume contains an additional cooling substance that is a light boiling liquid, the evaporator structure with the cooling substance therein serving as an evaporator portion for the additional cooling system, the light boiling liquid receiving thermal energy from the refrigerator condenser pipe at the evaporator structure so as to transform the light boiling liquid into a gaseous state;

a remote condensing unit located remotely from and above the refrigerator condenser pipe, the remote condensing unit condenses the additional cooling substance from the gaseous state to a liquid state; and vapor and condensed vapor lines that connect the remote condensing unit and the evaporator structure that convey the additional cooling substance in the gaseous state from the evaporator structure to the condensing unit and the condensed vapor line conveys the additional cooling substance from the condensing unit to the evaporator structure, a vapor block in the condensed vapor line to prevent vapor from flowing from the evaporator structure to the remote condensing unit through the condensed vapor line so that the additional cooling substance can circulate through the evaporator structure and the condensing unit and the vapor and condensed vapor lines only in a single circulation direction;

the evaporator structure and the remote condensing unit and the vapor and condensed vapor lines forming a circulatory system that moves the additional cooling substance through the additional cooling system by gravity to provide cooling of the refrigerator condenser pipe when an ambient temperature at the remote condensing unit is at a predetermined temperature differential below a temperature at the evaporator structure.

2. The assembly as claimed in claim 1, wherein the refrigerator condenser pipe is arranged as a serpentine pipe, wherein said serpentine pipe is predominantly formed of horizontal pipe sections.

3. The assembly as claimed in claim 1, wherein the light boiling liquid is Freon-22.

4. The assembly as claimed in claim 1, wherein the remote condensing unit comprises a reservoir as a leveling vessel that holds the condensed additional cooling substance, the reservoir being connected to receive the additional cooling substance that has condensed in the remote condensing unit.

5. The assembly as claimed in claim 1, wherein the refrigerator condenser pipe and the evaporator structure are located within the building, and the remote condensing unit is located in open atmosphere outside of the building containing the refrigerator pipe so as to be subject to outside ambient temperatures.

6. The assembly as claimed in claim 1, wherein the evaporator structure includes a structure that surrounds an outside of the refrigerator condenser pipe, and the additional cooling substance contacts the outside of the refrigerator condenser pipe to transfer heat from the refrigerator cooling agent to the additional cooling substance.

7. The assembly as claimed in claim 1, wherein the evaporator structure includes a structure that is located within the refrigerator condenser pipe, and the refrigerator cooling agent contacts the outside of the evaporator structure to transfer heat from the refrigerator cooling agent to the additional cooling substance.

8. The assembly as claimed in claim 1, wherein the additional system for cooling the refrigerator condenser pipe further comprises a shut-off valve that when operated to a closed position prevents circulation of the additional cooling substance of the system.

9. The assembly as claimed in claim 1, further comprising:

a water supply line that carries water to contact at least a part of the refrigerator condenser pipe or the additional cooling system to provide a further cooling of the refrigerator condenser pipe in addition to the additional cooling system.

10. The assembly as claimed in claim 9, wherein the evaporator structure of the additional cooling system is within the water supply line.

11. The assembly as claimed in claim 9, wherein the evaporator structure of the additional cooling system is outside of the water supply line.

12. The assembly as claimed in claim 9, wherein the evaporator structure of the additional cooling system and the water supply line are parallel and both located within the refrigerator condenser pipe.

13. The assembly as claimed in claim 9, wherein the water supply line further comprises a shut-off valve that prevents circulation of the water supply.

14. The assembly as claimed in claim 9, wherein the evaporator structure and the water supply line are parallel and are separated from each other and are each located within portions of the refrigerator condenser pipe.

15. The assembly as claimed in claim 1, wherein the vapor block includes a portion of the condensed vapor pipe formed into a U-shape in a vicinity of the remote condensing unit within which the additional cooling substance in liquid form to provide a vapor block in the condensed vapor line, the condensed vapor line being free of a vapor block so that the additional cooling substance circulates in a single direction within the additional cooling system.

16. A refrigerator condenser assembly, comprising:

a refrigerator condenser pipe containing a refrigerator cooling agent; and an additional cooling system for cooling the refrigerator condenser pipe, comprising:

an evaporator structure enclosing a volume adjacent to the refrigerator condenser pipe, wherein the volume contains an additional cooling substance that is a light boiling liquid, the evaporator structure with the cooling substance therein serving as an evaporator portion for the additional cooling system, the light boiling liquid receiving thermal energy from the refrigerator condenser pipe at the evaporator structure so as to transform the light boiling liquid into a gaseous state;

a remote condensing unit located remotely from and above the refrigerator condenser pipe, the remote condensing unit condenses the additional cooling substance from the gaseous state to a liquid state;

vapor and condensed vapor lines that connect the remote condensing unit and the evaporator structure that convey the additional cooling substance in the gaseous state from the evaporator structure to the condensing unit and that convey the additional cooling substance from the condensing unit to the evaporator structure;

the evaporator structure and the remote condensing unit and the vapor and condensed vapor lines forming a circulatory system that moves the additional cooling substance through the additional cooling system by gravity to provide cooling of the refrigerator condenser pipe when an ambient temperature at the remote condensing unit is at a predetermined temperature differential below a temperature at the evaporator structure;

the remote condensing unit comprising a reservoir as a leveling vessel that holds the condensed additional cooling substance, the reservoir being connected to receive the additional cooling substance that has condensed in the remote condensing unit; and the remote condensing unit comprising pipes within which the additional cooling substance is provided in a gaseous state, the pipes having ring ribs extending from external surfaces of the pipes through which heat is dissipated.

17. A refrigerator condenser assembly, comprising:

a refrigerator condenser pipe containing a refrigerator cooling agent within a building; and an additional cooling system for cooling the refrigerator condenser pipe, comprising:

an evaporator structure within the building and enclosing a volume adjacent to the refrigerator condenser pipe, wherein the volume contains an additional cooling substance that is a light boiling liquid, the evaporator structure with the additional cooling substance therein serving as an evaporator portion for the additional cooling system, the light boiling liquid receiving thermal energy from the refrigerator condenser pipe at the evaporator structure so as to transform the light boiling liquid into a gaseous state;

a remote condensing unit located outside the building and remotely from and above the refrigerator condenser pipe, the remote condensing unit condenses the additional cooling substance from the gaseous state to a liquid state; and a vapor line connected between the evaporator structure and the remote condensing unit to carry the additional cooling substance in the gaseous state from the evaporator structure to the remote condensing unit;

a condensed vapor line connected between the remote condensing unit and the evaporator structure to carry the additional cooling substance in the fluid state from the remote condensing unit to the evaporator structure;

a vapor lock in the condensed vapor line to trap the additional cooling substance in the fluid state so as to prevent flow of the additional cooling substance through the condensed vapor line; and the evaporator structure and the remove condensing unit and the vapor line and the condensed vapor line and the vapor lock form a circulatory system that circulates the additional cooling substance in a single direction using the force of gravity to provide cooling of the refrigerator condenser pipe when an ambient temperature at the remote condensing unit is at a predetermined temperature differential below a temperature at the evaporator structure, said circulatory system being a separate fluid circulatory system from a circulatory system of the refrigerator.

* * * * *